United States Patent [19]

Anderson

[11] 3,945,247

[45] Mar. 23, 1976

[54] PERCOLATION GAUGE

[76] Inventor: John D. Anderson, Box 157, Boulder Junction, Vilas County, Wis. 54512

[22] Filed: Oct. 18, 1974

[21] Appl. No.: 516,200

[52] U.S. Cl. ..... 73/73; 73/155

[51] Int. Cl.[2] ..... E21B 47/04

[58] Field of Search ..... 73/73, 74, 322, 38, 155, 73/291, 305

[56] References Cited

UNITED STATES PATENTS

| | | | |
|---|---|---|---|
| 1,908,196 | 5/1933 | Talbot | 73/322 |
| 3,374,324 | 3/1968 | McGrann | 73/73 X |

*Primary Examiner*—Jerry W. Myracle
*Attorney, Agent, or Firm*—Cushman, Darby & Cushman

[57] ABSTRACT

A method and apparatus for performing soil percolation tests. A housing member has upper and lower portions, with the lower portion adapted for insertion into a soil percolation test opening in the soil. A depth gauging member is mounted within the housing member for translational movement with respect to the housing member. The soil percolation test opening is filled to a predetermined level with water and the depth gauging member translated to a position indicative of the water level. After a predetermined time the water level in the percolation test opening falls due to absorption by the soil and the depth gauging member is translated to a new position indicative of the new water level. Calibration markings on the housing permit a direct reading of the amount by which the depth gauging member has been translated, which corresponds to the amount the water level in the percolation test opening has fallen. The housing member is also provided with a timer and with facilities for introducing water into the percolation test opening.

8 Claims, 7 Drawing Figures

Fig. 4
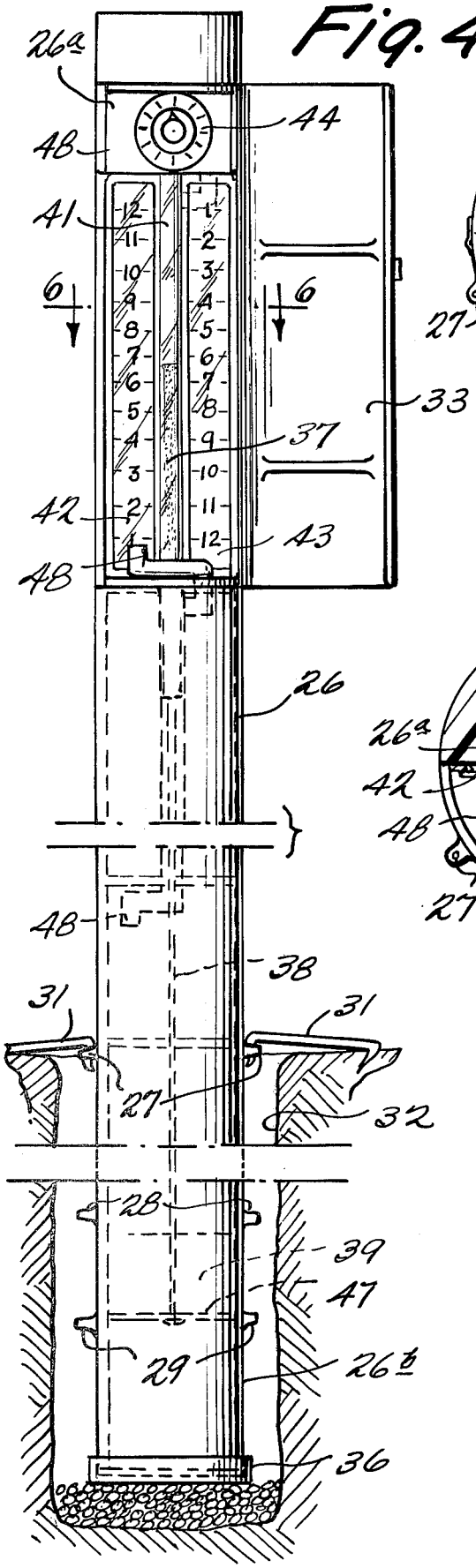
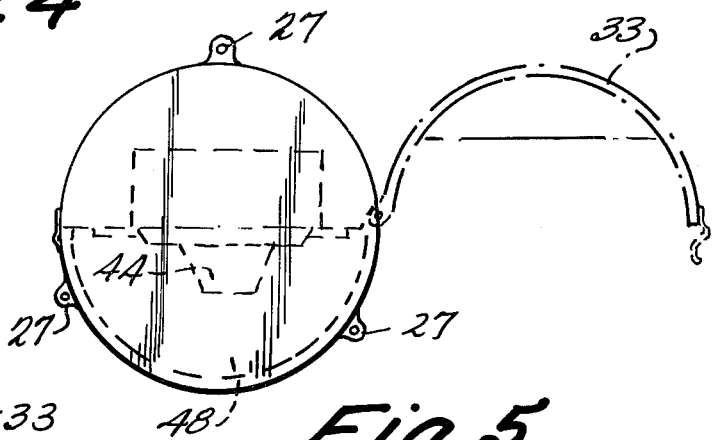
Fig. 5
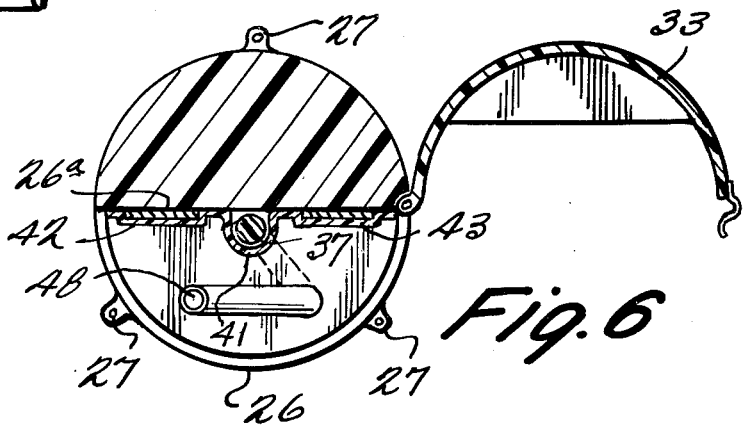
Fig. 6
Fig. 7
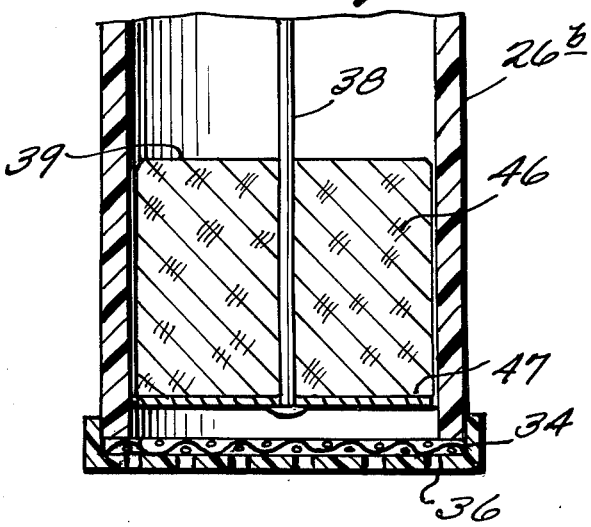

PERCOLATION GAUGE

BACKGROUND OF THE INVENTION

This invention pertains to a method and apparatus for performing soil percolation tests for determining the water absorption characteristics of soil.

The water absorption or percolation characteristics of soil are very important in determining the uses to which land can be put. That is, the erection of any structure on a plot of land causes water run-off due to the elements as well as water run-off from a septic tank or the like, if such is provided. The percolation characteristics of soil varies widely, and it is important to know what the percolation characteristics are of a given piece of land prior to erecting any structure on it. The soil has to be such that it can absorb the water run-off, else the structure should not be built. Many governmental organizations charged with land use and zoning responsibility in fact require a test of such percolation characteristics as a prerequisite of obtaining a building permit.

In the past, soil percolation tests have been performed by augering a test opening in the ground to a predetermined depth, and then filling the test opening with water to a predetermined depth, i.e., 12 inches. After a predetermined time, such as 10 minutes, the drop in water level is measured by manually inserting a ruler in the test opening and estimating the amount by which the water level has dropped. Then the water level is brought back up to its original level by pouring more water in the opening so as to perform additional absorption measurements. If this is not very carefully done, soil from the sides of the opening can be dislodged by the water and fall into the opening, causing errors and distortions in the percolation tests.

This prior percolation test technique did not produce consistent and accurate test results because it is necessarily dependent upon the person making the measurements, and subject to many errors in the way a ruler is inserted into the test opening, trying to read the water level from the ruler down in the opening, etc.

OBJECTS AND SUMMARY OF THE INVENTION

Accordingly, it is an object of this invention to provide a method and apparatus for performing soil percolation tests which yields accurate and consistent data.

It is another object of this invention to provide soil percolation test apparatus having a upper portion which extends out of a test opening and gives on this upper portion a direct reading of water level in the test opening.

Briefly, in accordance with one embodiment of the invention, there is provided a housing member having top and bottom portions with the bottom portion of the housing member adapted for insertion into a percolation test opening in the soil. A depth gauging member is mounted within the housing member extending into the top and bottom portions thereof, and is mounted for transactional movement with respect to the housing member. Means are provided to translate the depth gauging member an amount corresponding to changes in water level in the test opening, whereby the amount of such translational movement serves as an indication of the percolation characteristics of the soil under test.

BRIEF DESCRIPTION OF THE DRAWINGS

FIG. 4 is an elevation of another embodiment of soil percolation test apparatus in accordance with the invention showing it in place in a soil percolation test opening.

FIG. 5 is a top view of the apparatus of FIG. 4.

FIG. 6 is a sectional view taken along the line 6—6 of FIG. 4.

FIG. 7 is a sectional view of the bottom portion of the apparatus of FIG. 4.

DESCRIPTION OF THE PREFERRED EMBODIMENTS

Figure 1:
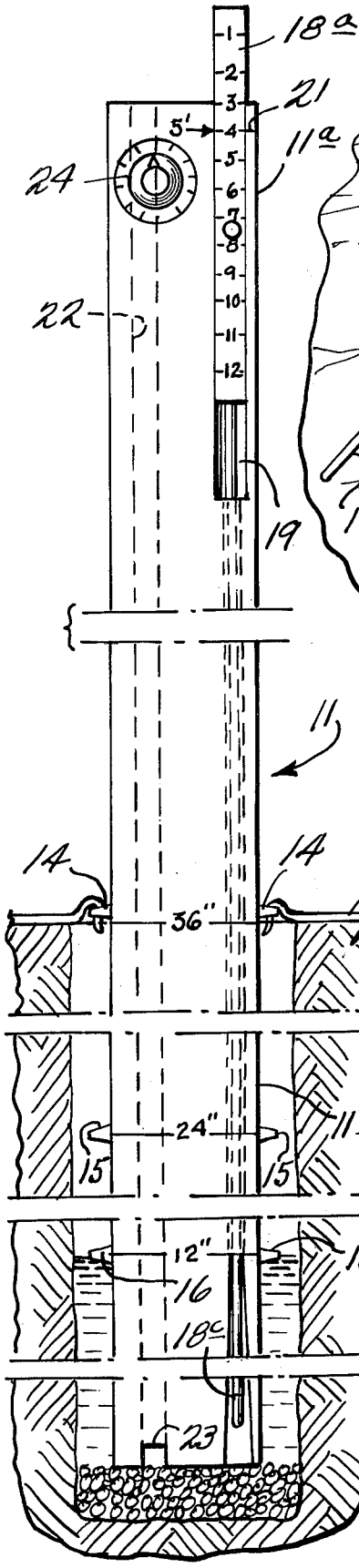
FIG. 1 is an elevation of one embodiment of soil percolation test apparatus in accordance with the invention showing it in place in a soil percolation test opening.
Figure 2:
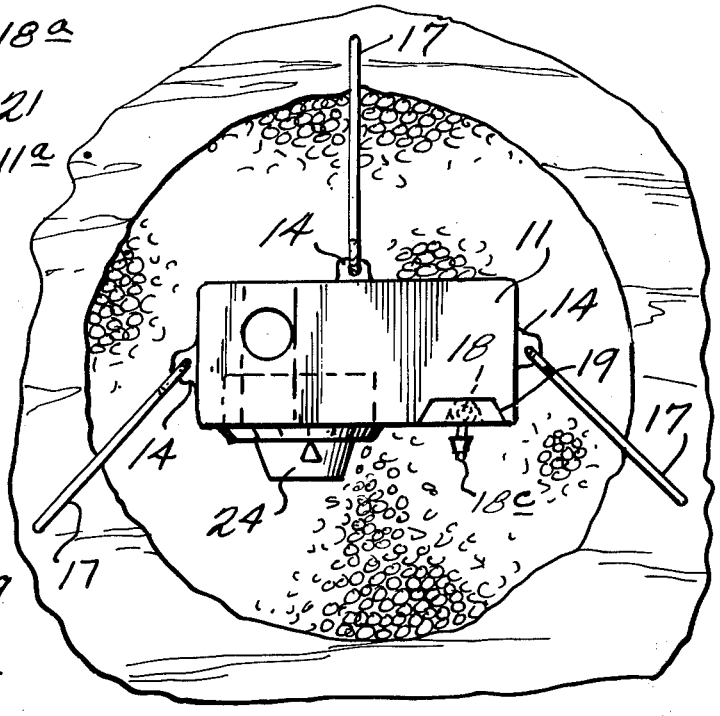
FIG. 2 is a top view of the apparatus of FIG. 1.
Figure 3:
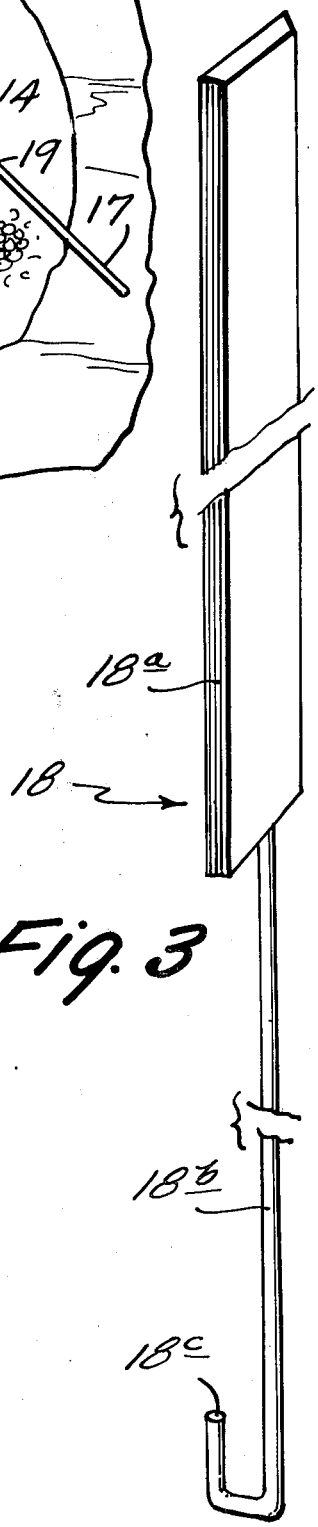
FIG. 3 is a perspective view of the depth gauging member in the apparatus of FIG. 1.

Turning now to a consideration of the drawings, FIGS. 1 through 3 pertain to one embodiment of soil percolation test apparatus in accordance with the invention. The apparatus includes a housing 11 having a top portion 11*a* and a bottom portion 11*b*. As shown in FIG. 1, the bottom portion 11*b* is adapted to be placed in a soil percolation test opening generally devoted by reference numeral 12. The soil percolation test opening may have a layer of gravel 13 (say, two inches of gravel) placed in the bottom thereof upon which the bottom portion 11*b* of the housing 11 rests. Typically, the test opening 12 has a predetermined depth (36 inches, for example). In order to anchor the housing 11 in place and hold it upright a plurality of sets of anchor tabs 14, 15 and 16 are provided spaced along the length of the bottom portion 11*b* of the housing member. Three sets of anchor tabs are illustrated, although of course more or less than three may be provided depending upon the various depth test openings within which the apparatus is to be used. The tabs 14 are illustrated in FIG. 1 as being approximately level with the ground surface and have anchors 17 anchoring the anchor tabs 14 and hence the housing 11 to the ground.

A depth gauging member 18 is provided mounted within the housing 11. The depth gauging member comprises a top portion 18*a* and a bottom portion 18*b* including an upturned portion 18*c*. The top portion 18*a* of the depth gauging member is frictionally mounted in a slot 19 formed in the upper portion 11*a* of the housing member. This frictional mounting enables the depth gauging member 18 to be moved or translated with respect to the housing 11, but such that the depth gauging member 18 if frictionally held at whatever position it is set.

A reference mark 21 is provided on the upper portion 11*a* of the housing adjacent the top portion 18*a* of the depth gauging member. The reference mark 21 is positioned such that when the turnedup portion 18*c* of depth gauging member 18 is at the bottom of the test opening 12, the very top of the top portion 18*a* of the depth gauging member 18 is exactly adjacent the reference mark. The top portion 18*a* of the depth gauging member is provided with scale markings, such as from 0 to 12 inches.

A water pipe 22 is mounted within the housing 11 and extends from the very top down to within a small distance from the bottom terminating in an opening 23.

A timer 24 is also mounted for convenience in the top portion of the housing 11.

In operation, after the test opening 12 has been suitably formed as by augering a hole in the ground, the housing (or at least the bottom portion 11*b* thereof) is inserted into the test opening and suitably anchored by anchors 17. Next, assuming that the percolation test involves measuring the drop in water level from an initial level of twelve inches, the test opening 12 is filled with water to a level of 12 inches. This is done by manually translating the depth gauging member until the 12 inch scale marking therein is opposite the reference marking 21. The upturned portion 18*c* of the depth gauging member is correspondingly positioned 12 inches from the bottom of test opening 12. Water is then poured into the water pipe 22 until an observer looking down into the test opening 12 can just see the water level starting to cover the upturned portion 18*c*. At that point there are 12 inches of water in the test opening and no more water is poured.

The timer 24 is then set to whatever period of time is required for the percolation test, i.e., 10 minutes. After this time has elapsed, it is necessary to measure the distance that the water level has fallen in the test opening 12. This is done by translating the depth gauging member 18 until the upturned portion 18*c* again is just at the top of the water level as seen by an observer. With the depth gauging member at this position, then by noting the scale markings on its top portion adjacent the refernce marking 21, the amount by which the water level fell is noted.

Turning now to a consideration of FIGS. 4 through 7, there is illustrated another embodiment of soil percolation test apparatus in accordance with the invention. A housing 26 has a top portion 26*a* and a bottom portion 26*b*, there being provided a plurality of sets of anchor tabs 27, 28 and 29 along the length of the bottom portion 26*b*. Anchors 31 extend between the anchor tabs 27 and the ground to anchor the housing to the ground and hold it upright within the test opening 32.

As shown in the drawings, the housing 26 is a cylindrical housing constructed of plastic, for example. A hinged door 33 is provided in the upper portion 26*a* of the housing, and a screen 34 is provided across the bottom of the housing 26 with an appropriate apertured cap 36 holding the screen 34 in place.

A depth gauging member is mounted within the housing 26. The depth gauging member comprises an indicator portion 37 coupled through a member 38 to a float assembly 39. The indicator portion 37 fits within a transparent indicator housing 41 provided within the housing portion 26*a*, but can translate or move up and down within the indicator housing. Calibrated scales 42 and 43 are provided within the housing 26 suitably mounted to either side of the indicator housing 41. For convenience, a timer 44 is also mounted in the housing 26.

The float assembly 39 comprises a mass of floatation material 46, such as styrofoam, together with a member 47 made of a stronger material such as metal, to which the member 38 is suitably attached. A water pipe 48 is provided mounted within and extending partially down the interior of the housing 26.

In operation, the test opening is filled to a predetermined level with water by pouring water through the water pipe 48 with the water passing around the float assembly 39 and through the screen 34 and apertured cap 36 into the test opening 32. As the water level begins to rise, the float assembly 39 rises on the rising water, causing the indicator 37 to rise within the indicator housing 41. The tip of the indicator as measured against the calibrated scales 42 and 43 provides an indication of the position of the water level in the test opening 32. Thus, for example, it it is desired to fill the test opening 32 with 12 inches of water, water is poured into the water pipe 48 until the tip of indicator 37 is opposite the 12 inch marking on scale 42. This corresponds to 12 inches of water in the test opening 32. Then the timer 44 is set to whatever elapsed time period is desired. After the desired time has elapsed, it is only necessary to observe the position of the tip of the indicator 37 against the scale 43 to determine the amount by which the water level has fallen, since the float assembly 39 and hence indicator 37 follows the falling water level.

Although the invention has been described with reference to certain specific embodiments, modifications may be made to the specific embodiments disclosed without departing from the true spirit and scope of the invention.

What is claimed is:

1. A method of performing ground percolation tests comprising the steps of making a percolation test opening in the ground, inserting an at least partially hollow housing having a calibrated depth gauging member mounted for translation therein into the percolation test opening, filling the percolation test opening with water through the at least partially hollow housing to a predetermined level, causing the depth gauging member to be continuously translated with respect to the housing corresponding to the continuous change in water level in the percolation test opening as water is absorbed in the ground, whereby the amount said depth gauging member is thus translated during a predetermined time serves as an indication of the percolation characteristics of the ground.

2. A depth gauge for use in performing ground percolation tests comprising an at least partially hollow housing member having top and bottom portions, the bottom portion of said housing member adapted for insertion into a percolation test opening, an inner calibrated depth gauging member mounted within said housing member for translational movement with respect thereto, said at least partially hollow housing member having conduit means mounted therein for conducting water introduced into the upper portion of said housing to the lower portion of the housing where it can be discharged to thereby fill the percolation test opening with water without any erosion thereof, means for causing said depth gauging member to be continuously translated with respect to said housing member corresponding to the continuous change in water level in said percolation test opening as water therein is absorbed in the surrounding ground, whereby the amount of such translational movement during a predetermined time period serves as an indication of the percolation characteristics of the ground.

3. Apparatus in accordance with claim 2 wherein said means for causing said depth gauging member to be translated comprises a float assembly connected to a bottom portion of said depth gauging member, whereby said float and hence said depth gauging member is translated in accordance with the water level in said percolation test opening.

4. Apparatus in accordance with claim 2 wherein said housing member includes calibration markings adjacent an upper portion of said depth gauging member.

5. Apparatus in accordance with claim 2 wherein said conduit means comprises an inner water supply pipe extending along a portion of said housing member and terminating adjacent the bottom thereof.

6. Apparatus in accordance with claim 2 wherein said housing member includes provisions for anchors wherein the housing may be anchored to the ground in an upright position.

7. A depth gauge for use in performing ground percolation tests comprising a housing member having top and bottom portions, the bottom portion of said housing member adapted for insertion into a percolation test opening, water conduit means contained within said housing for carrying water introduced into the top portion of said housing into the lower portion of said housing and discharging same into the bottom of a percolation test opening, a depth gauging member having top and bottom portions mounted within said housing member for translational movement with respect thereto, said housing member having a calibration marking on the upper portion thereof adjacent the upper portion of said housing, whereby when the lower portion of said depth gauging member is positioned at the water level the position of the upper portion of said depth gauging member with respect to the calibration marking is indicative of the water level.

8. A depth gauge for use in performing ground percolation tests comprising a housing member having top and bottom portions, the bottom portion of said housing member adapted for insertion into a percolation test opening, an inner calibrated depth gauging member mounted within said housing means for translation or movement with respect thereto, said housing member including an inner water supply pipe extending along a portion of said housing member and terminating adjacently bottom thereof, means for causing said depth gauging member to be translated with respect to said housing member and amount corresponding to the change in water level in said percolation test opening, whereby the amount of such translation or movement serves as an indication of the percolation characteristics of the ground.

* * * * *